US012736052B2

(12) United States Patent
Kohama et al.

(10) Patent No.: US 12,736,052 B2
(45) Date of Patent: Sep. 15, 2026

(54) SCROLL COMPRESSOR

(71) Applicant: KABUSHIKI KAISHA TOYOTA JIDOSHOKKI, Aichi (JP)

(72) Inventors: Keisuke Kohama, Aichi (JP); Takuro Yamashita, Aichi (JP); Tsubasa Mitsui, Aichi (JP); Shiori Yamamoto, Aichi (JP); Ami Fujiwara, Aichi (JP); Yuki Nagahara, Aichi (JP); Kunihisa Matsuda, Aichi (JP); Tsuyoshi Yamaguchi, Aichi (JP); Shuto Onitsuka, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 19/245,987

(22) Filed: Jun. 23, 2025

(65) Prior Publication Data

US 2026/0002534 A1 Jan. 1, 2026

(30) Foreign Application Priority Data

Jul. 1, 2024 (JP) ..... JP2024-106240

(51) Int. Cl.

| | |
|---|---|
| ***F04C 27/00*** | (2006.01) |
| ***F04C 18/02*** | (2006.01) |
| *F04C 23/00* | (2006.01) |

(52) U.S. Cl.

CPC ..... *F04C 27/005* (2013.01); *F04C 18/0215* (2013.01); *F04C 18/0253* (2013.01); *F04C 23/008* (2013.01); *F04C 2240/805* (2013.01)

(58) Field of Classification Search

CPC .. F04C 27/005; F04C 18/0215; F04C 23/008; F04C 2240/805; F04C 18/0253

See application file for complete search history.

(56) References Cited

U.S. PATENT DOCUMENTS

2022/0307501 A1 9/2022 Yamamoto et al.

FOREIGN PATENT DOCUMENTS

| | | | | |
|---|---|---|---|---|
| CN | 117917505 A | * | 4/2024 | ..... F04C 18/0246 |
| EP | 1818541 A1 | * | 8/2007 | ..... F04C 27/005 |
| JP | 2022-149824 A | | 10/2022 | |

OTHER PUBLICATIONS

English Translation of CN117917505 A (Year: 2024).*

* cited by examiner

*Primary Examiner* — Charles G Freay

(74) *Attorney, Agent, or Firm* — Greenblum & Bernstein, P.L.C.

(57) ABSTRACT

A scroll compressor includes a housing, a rotary shaft rotatably supported by the housing, a fixed scroll including a fixed scroll base plate, a fixed scroll spiral wall, a fixed scroll peripheral wall, an orbiting scroll including an orbiting scroll base plate, and an orbiting scroll spiral wall, and an elastic plate. The fixed scroll peripheral wall includes a plurality of thick-walled portions spaced from each other in the circumferential direction of the fixed scroll peripheral wall. A groove is formed in at least one of end surfaces of the plurality of thick-walled portions facing the elastic plate, and accommodates elastic deformation of the elastic plate so that a backpressure chamber and an intake passage are in communication with each other when a pressure difference between the backpressure chamber and an intake passage exceeds a predetermined value.

5 Claims, 5 Drawing Sheets

SCROLL COMPRESSOR

CROSS-REFERENCE TO RELATED APPLICATION

This application claims priority to Japanese Patent Application No. 2024-106240 filed on Jul. 1, 2024, the entire disclosure of which is incorporated herein by reference.

The present disclosure relates to a scroll compressor.

BACKGROUND ART

Japanese Patent Application Publication No. 2022-149824 discloses a scroll compressor including a housing, a rotary shaft, a fixed scroll, an orbiting scroll, and an elastic plate. The rotary shaft is rotatably supported by the housing. The fixed scroll has a fixed scroll base plate, a fixed scroll spiral wall, and a fixed scroll peripheral wall. The fixed scroll spiral wall extends from the fixed scroll base plate. The fixed scroll peripheral wall extends from the fixed scroll base plate and surrounds the fixed scroll spiral wall. The orbiting scroll includes an orbiting scroll base plate, and an orbiting scroll spiral wall. The orbiting scroll base plate faces the fixed scroll base plate. The orbiting scroll spiral wall extends from the orbiting scroll base plate toward the fixed scroll base plate and meshes with the fixed scroll spiral wall. A compression chamber for compressing refrigerant is defined by the fixed scroll base plate, the fixed scroll spiral wall, the orbiting scroll base plate, and the orbiting scroll spiral wall. The orbiting scroll makes orbital motion inside the fixed scroll peripheral wall with rotation of the rotary shaft. The elastic plate urges the orbiting scroll toward the fixed scroll.

The housing includes a shaft support housing, a discharge housing, and a suction housing. The shaft support housing is disposed on a side of the orbiting scroll base plate opposite from the fixed scroll base plate. The shaft support housing supports the rotary shaft. The discharge housing has an end wall and a peripheral wall. The peripheral wall extends from the end wall in a tubular shape, and surrounds the fixed scroll peripheral wall. The discharge housing defines a discharge chamber between the end wall and the fixed scroll base plate. Refrigerant compressed in the compression chamber is discharged to the discharge chamber. The suction housing and the shaft support housing cooperate to define a suction chamber into which refrigerant is drawn from an outside.

An intake passage is defined between the fixed scroll peripheral wall of the fixed scroll and the peripheral wall of the discharge housing. Refrigerant in the suction chamber is drawn into the compression chamber through the intake passage. A backpressure chamber is defined between the orbiting scroll base plate and the shaft support housing. Refrigerant for urging the orbiting scroll toward the fixed scroll is introduced into the backpressure chamber. An outer peripheral portion of the elastic plate is held between the fixed scroll peripheral wall and the shaft support housing.

The peripheral wall of the discharge housing has a plurality of bulging portions. The bulging portions are spaced from each other in a circumferential direction of the peripheral wall, and protrude toward the fixed scroll peripheral wall with an inner peripheral surface of the peripheral wall formed into a convex shape. The discharge housing is fastened to the suction housing by fastening members that extend through portions of the peripheral wall corresponding to the bulging portions in an axial direction of the peripheral wall. The fixed scroll is fixed to the housing with the fixed scroll peripheral wall held between the end wall of the discharge housing and the shaft support housing in the axial direction of the peripheral wall by a fastening force of the fastening members.

The fixed scroll peripheral wall has a plurality of thick-walled portions and a plurality of thin-walled portions. The thick-walled portions are spaced from each other in the circumferential direction of the fixed scroll peripheral wall. The thin-walled portions are formed with an outer peripheral surface of the fixed scroll peripheral wall recessed in a concave shape between the thick-walled portions disposed adjacent to each other in the circumferential direction of the fixed scroll peripheral wall to allow the bulging portions to be disposed, and each have a thickness smaller than a thickness of each of the thick-walled portions. This configuration allows the scroll compressor to be smaller.

In this scroll compressor, when the scroll compressor is stopped, refrigerant may be cooled and liquefied. If the scroll compressor is started, for example, in a state in which liquefied refrigerant generated by liquefaction of refrigerant is present in the backpressure chamber, heat of refrigerant compressed in the compression chamber may be transmitted to the liquefied refrigerant in the backpressure chamber via the orbiting scroll base plate. This may cause the liquefied refrigerant in the backpressure chamber to vaporize, which may increase a pressure in the backpressure chamber excessively. If the pressure in the backpressure chamber increases excessively, an urging force, which is generated by the pressure in the backpressure chamber and urges the orbiting scroll toward the fixed scroll, becomes too large. As a result, it becomes difficult for the orbiting scroll to make orbital motion, and the compression efficiency of the scroll compressor decreases.

Furthermore, in the above-mentioned scroll compressor of the Publication, the thin-walled portions are closer to the bulging portions than the thick-walled portions. The fastening members extend through portions of the peripheral wall of the discharge housing corresponding to the bulging portions in an axial direction of the peripheral wall. Therefore, a reaction force from the shaft support housing caused by a fastening force of the fastening members is more likely to act locally on end surfaces of the thin-walled portions facing the elastic plate, as compared to end surfaces of the thick-walled portion facing the elastic plate. In this case, if a groove is formed in the end surfaces of the thin-walled portions facing the elastic plate, the end surfaces of the thin-walled portions facing the elastic plate are less likely to receive the reaction force from the shaft support housing caused by the fastening force of the fastening members. Therefore, there is a risk that it will be difficult for the fixed scroll peripheral wall to withstand the fastening force of the fastening members between the end wall of the discharge housing and the shaft support housing. If a strength of the fixed scroll is reduced in this manner, a failure such as deformation of the fixed scroll may occur. Therefore, it is desirable to suppress an excessive increase in pressure in the backpressure chamber while the strength of the fixed scroll is maintained.

SUMMARY

In accordance with an aspect of the present disclosure, there is provided a scroll compressor including a housing, a rotary shaft rotatably supported by the housing, a fixed scroll fixed to the housing, and including a fixed scroll base plate, a fixed scroll spiral wall that extends from the fixed scroll base plate, a fixed scroll peripheral wall that extends from the fixed scroll base plate and surrounds the fixed scroll spiral wall, an orbiting scroll including an orbiting scroll base plate that faces the fixed scroll base plate, and an orbiting scroll spiral wall that extends from the orbiting scroll base plate toward the fixed scroll base plate and meshes with the fixed scroll spiral wall, the orbiting being configured to make orbital motion inside the fixed scroll peripheral wall with rotation of the rotary shaft, an elastic plate having an annular shape, and configured to urge the orbiting scroll toward the fixed scroll, and a compression chamber in which a refrigerant is compressed and that is defined by the fixed scroll base plate, the fixed scroll spiral wall, the orbiting scroll base plate, and the orbiting scroll spiral wall. The housing includes a shaft support housing that is disposed on a side of the orbiting scroll base plate opposite from the fixed scroll base plate, and supports the rotary shaft, a discharge housing that includes an end wall, and a peripheral wall extending from the end wall in a tubular shape so as to surround the fixed scroll peripheral wall, and defines a discharge chamber to which the refrigerant compressed in the compression chamber is discharged between the end wall and the fixed scroll base plate, and a suction housing cooperating with the shaft support housing to define a suction chamber into which the refrigerant is drawn from an outside. The scroll compressor includes an intake passage that is defined between the fixed scroll peripheral wall and the peripheral wall, and through which the refrigerant in the suction chamber is drawn into the compression chamber, a backpressure chamber that is defined between the orbiting scroll base plate and the shaft support housing, and into which the refrigerant to urge the orbiting scroll toward the fixed scroll is introduced, an outer peripheral portion of the elastic plate held between the fixed scroll peripheral wall and the shaft support housing, a plurality of bulging portions spaced from each other in a circumferential direction of the peripheral wall, and protruding toward the fixed peripheral wall with an inner peripheral surface of the peripheral wall formed into a convex shape, a fastening member extending through a portion of the peripheral wall where the plurality of bulging portions is formed in an axial direction of the peripheral wall to fix the discharge housing to the suction housing, and the fixed scroll fixed to the housing with the fixed scroll peripheral wall held between the end wall and the shaft support housing by a fastening force of the fastening member. The fixed scroll peripheral wall includes a plurality of thick-walled portions spaced from each other in the circumferential direction of the fixed scroll peripheral wall, and a plurality of thin-walled portions formed with an outer peripheral surface of the fixed scroll peripheral wall recessed in a concave shape between the plurality of thick-walled portions disposed adjacent to each other in the circumferential direction of the fixed scroll peripheral wall to allow the bulging portions to be disposed, and having a thickness smaller than a thickness of each of the plurality of thick-walled portions. A groove is formed in at least one of end surfaces of the plurality of thick-walled portions facing the elastic plate, the groove accommodating elastic deformation of the elastic plate so that the backpressure chamber and the intake passage are in communication with each other when a pressure difference between the backpressure chamber and the intake passage exceeds a predetermined value.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of a scroll compressor with reference to FIGS. 1 to 8. The scroll compressor of the present embodiment is used for a vehicle air conditioner, for example.

Basic Configuration of Scroll Compressor

Figure 1:
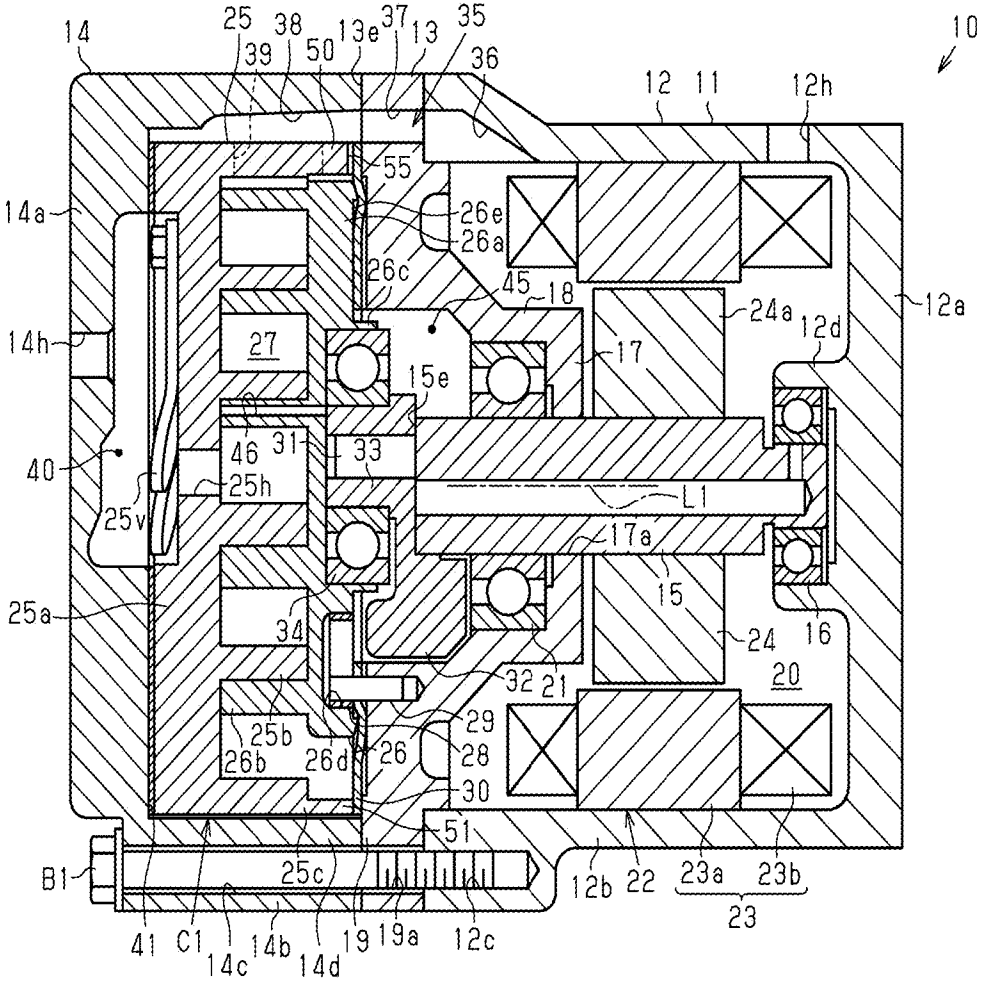
FIG. 1 is a cross-sectional view of a scroll compressor according to an embodiment.

As illustrated in FIG. 1, a scroll compressor 10 includes a housing 11 having a tubular shape. The housing 11 includes a suction housing 12, a shaft support housing 13, and a discharge housing 14. The suction housing 12, the shaft support housing 13, and the discharge housing 14 are made of metal materials. The suction housing 12, the shaft support housing 13, and the discharge housing 14 are made of, for example, aluminum. The scroll compressor 10 includes a rotary shaft 15. The rotary shaft 15 is accommodated in the housing 11.

The suction housing 12 includes an end wall 12*a* having a plate shape, and a peripheral wall 12*b* having a tubular shape. The peripheral wall 12*b* extends in a tubular shape from an outer peripheral portion of the end wall 12*a*. An axial direction of the peripheral wall 12*b* coincides with an axial direction of the rotary shaft 15. The suction housing 12 has a plurality of internally threaded holes 12*c*. Six internally threaded holes 12*c* are formed in the suction housing 12. The internally threaded holes 12*c* are formed in an opening end of the peripheral wall 12*b*. The six internally threaded holes 12*c* are arranged at regular intervals in a circumferential direction of the peripheral wall 12*b*. For the sake of description, only one of the internally threaded holes 12*c* is illustrated in FIG. 1. The suction housing 12 has an inlet port 12*h* through which refrigerant is drawn from an outside. The inlet port 12*h* is formed in the peripheral wall 12*b* on the end wall 12*a* side. The inlet port 12*h* provides communication between an inside and an outside of the suction housing 12.

The suction housing 12 has a boss 12*d* having a cylindrical shape. The boss 12*d* protrudes from a central portion of an inner surface of the end wall 12*a*. A first end of the rotary shaft 15 corresponding to one end of the rotary shaft 15 in the axial direction is inserted into the boss 12*d*. The scroll compressor 10 includes a bearing 16. The bearing 16 is, for example, a rolling bearing. The bearing 16 is disposed between an inner peripheral surface of the boss 12*d* and an outer peripheral surface of the first end of the rotary shaft 15.

The first end of the rotary shaft 15 is rotatably supported by the suction housing 12 via the bearing 16.

The shaft support housing 13 has an end wall 17 having a plate shape and a peripheral wall 18 having a tubular shape. The peripheral wall 18 protrudes from an outer peripheral portion of the end wall 17 in a tubular shape. An axial direction of the peripheral wall 18 coincides with the axial direction of the rotary shaft 15. The shaft support housing 13 has a flange wall 19 having a ring shape. The flange wall 19 extends outwardly in a radial direction of the rotary shaft 15 from an end of an outer peripheral surface of the peripheral wall 18 opposite from the end wall 17.

The shaft support housing 13 has an insertion hole 17*a* having a circular hole shape. The insertion hole 17*a* is formed in a central portion of the end wall 17. The insertion hole 17*a* extends through the end wall 17 in a thickness direction of the end wall 17. The rotary shaft 15 is inserted through the insertion hole 17*a*. An end surface 15*e* of the rotary shaft 15 positioned on a second end of the rotary shaft 15 corresponding to the other end thereof in the axial direction is positioned inside the peripheral wall 18.

The scroll compressor 10 includes a bearing 21. The bearing 21 is, for example, a rolling bearing. The bearing 21 is disposed between an inner peripheral surface of the peripheral wall 18 and an outer peripheral surface of the rotary shaft 15. The rotary shaft 15 is rotatably supported by the shaft support housing 13 via the bearing 21. Thus, the shaft support housing 13 rotatably supports the rotary shaft 15. Accordingly, the rotary shaft 15 is rotatably supported by the housing 11.

The shaft support housing 13 has a plurality of bolt insertion holes 19*a*. Six bolt insertion holes 19*a* are formed in the shaft support housing 13. The bolt insertion holes 19*a* are formed in an outer peripheral portion of the flange wall 19. The six bolt insertion holes 19*a* are disposed at regular intervals in a circumferential direction of the flange wall 19. The bolt insertion holes 19*a* each extend through the flange wall 19 in a thickness direction thereof. The bolt insertion holes 19*a* of the flange wall 19 are in communication with their associated internally threaded holes 12*c* of the suction housing 12. For the sake of description, only one of the bolt insertion holes 19*a* is illustrated in FIG. 1.

The scroll compressor 10 includes a suction chamber 20. The suction chamber 20 is defined by the suction housing 12 and the shaft support housing 13. Thus, the suction housing 12 and the shaft support housing 13 cooperate to define the suction chamber 20. In this way, the suction chamber 20 is formed in the housing 11. The suction chamber 20 is in communication with the inlet port 12*h*. Refrigerant is drawn into the suction chamber 20 through the inlet port 12*h*. Therefore, refrigerant is drawn into the suction chamber 20 from an outside. Thus, the suction chamber 20 is a suction pressure region.

The scroll compressor 10 includes a motor 22. The motor 22 is accommodated in the suction chamber 20. The motor 22 includes a stator 23 having a tubular shape, and a rotor 24 having a tubular shape. The rotor 24 is disposed inside the stator 23. The rotor 24 rotates integrally with the rotary shaft 15. The stator 23 surrounds the rotor 24. The rotor 24 includes a rotor core 24*a* fixed to the rotary shaft 15, and a plurality of permanent magnets (not illustrated) disposed in the rotor core 24*a*.

The stator 23 includes a stator core 23*a* having a tubular shape, and a motor coil 23*b*. The stator core 23*a* is fixed to an inner peripheral surface of the peripheral wall 12*b* of the suction housing 12. The motor coil 23*b* is wound on the stator core 23*a*. Then, electric power controlled by an inverter (not illustrated) is supplied to the motor coil 23*b*, so that the rotor 24 rotates. Thus, the rotor 24 rotates integrally with the rotary shaft 15. Accordingly, the motor 22 rotates the rotary shaft 15.

The scroll compressor 10 includes a compression mechanism C1. The compression mechanism C1 includes a fixed scroll 25 and an orbiting scroll 26. Thus, the scroll compressor 10 includes the fixed scroll 25 and the orbiting scroll 26. The compression mechanism C1 is of the scroll type. The orbiting scroll 26 makes orbital motion relative to the fixed scroll 25 with rotation of the rotary shaft 15.

Figure 2:
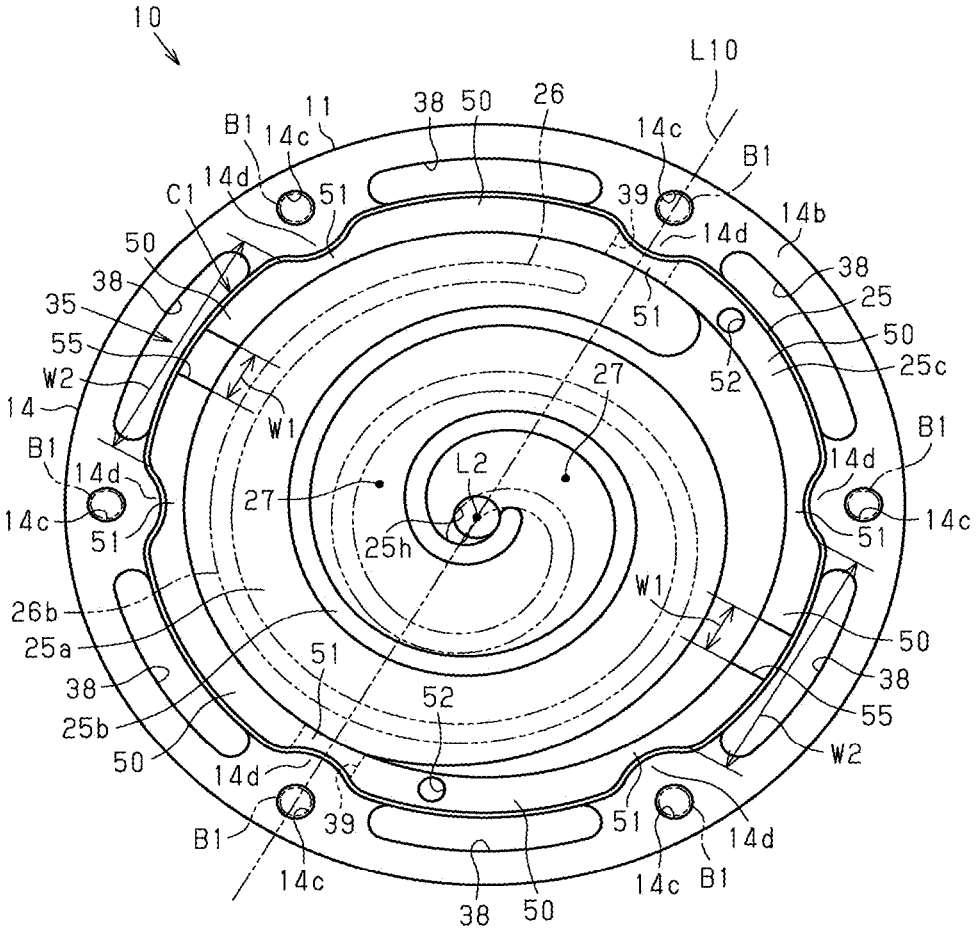
FIG. 2 is a front view of a discharge housing and a fixed scroll.

As illustrated in FIGS. 1 and 2, the fixed scroll 25 has a fixed scroll base plate 25*a*, a fixed scroll spiral wall 25*b*, and a fixed scroll peripheral wall 25*c*. The fixed scroll base plate 25*a* has a disk shape. A discharge port 25*h* is formed in a center of the fixed scroll base plate 25*a*. The discharge port 25*h* has a circular hole shape. The discharge port 25*h* extends through the fixed scroll base plate 25*a* in a thickness direction thereof. The fixed scroll spiral wall 25*b* extends from the fixed scroll base plate 25*a*. The fixed scroll peripheral wall 25*c* extends from an outer peripheral portion of the fixed scroll base plate 25*a*. The fixed scroll peripheral wall 25*c* surrounds the fixed scroll spiral wall 25*b*.

As illustrated in FIG. 1, the scroll compressor 10 includes a valve mechanism 25*v*. The valve mechanism 25*v* is mounted on an end surface of the fixed scroll base plate 25*a* opposite from the fixed scroll spiral wall 25*b*. The valve mechanism 25*v* is configured to open or close the discharge port 25*h*.

The orbiting scroll 26 includes an orbiting scroll base plate 26*a* and an orbiting scroll spiral wall 26*b*. The orbiting scroll base plate 26*a* has a disk shape. The orbiting scroll base plate 26*a* faces the fixed scroll base plate 25*a*. The orbiting scroll spiral wall 26*b* extends from the orbiting scroll base plate 26*a* towards the fixed scroll base plate 25*a*. The orbiting scroll spiral wall 26*b* meshes with the fixed scroll spiral wall 25*b*. The orbiting scroll 26 is disposed inside the fixed scroll peripheral wall 25*c*. The orbiting scroll 26 makes orbital motion inside the fixed scroll peripheral wall 25*c*. A distal end surface of the fixed scroll spiral wall 25*b* is in contact with the orbiting scroll base plate 26*a*. A distal end surface of the orbiting scroll spiral wall 26*b* is in contact with the fixed scroll base plate 25*a*.

The scroll compressor 10 has a compression chamber 27. The compression chamber 27 is defined by the fixed scroll base plate 25*a*, the fixed scroll spiral wall 25*b*, the orbiting scroll base plate 26*a*, and the orbiting scroll spiral wall 26*b*. Thus, the compression chamber 27 is defined between the fixed scroll 25 and the orbiting scroll 26. Refrigerant from an outside is drawn into and compressed in the compression chamber 27.

The orbiting scroll base plate 26*a* has a boss 26*c* having a cylindrical shape. The boss 26*c* protrudes toward an inside of the peripheral wall 18 of the shaft support housing 13 from an end surface 26*e* of the orbiting scroll base plate 26*a* opposite from the fixed scroll base plate 25*a*. The shaft support housing 13 is disposed on a side of the orbiting scroll base plate 26*a* opposite from fixed scroll base plate 25*a*. An axial direction of the boss 26*c* coincides with the axial direction of the rotary shaft 15. The orbiting scroll base plate 26*a* has a plurality of grooves 26*d*. The grooves 26*d* are formed in the end surface 26*e* of the orbiting scroll base plate 26*a* around the boss 26*c*. The grooves 26*d* are disposed at predetermined intervals in a circumferential direction of the rotary shaft 15. For the sake of description, only one of the grooves 26*d* is illustrated in FIG. 1. Ring members 28 each having a ring shape are fitted into the grooves 26*d*, respectively. Pins 29 are each inserted into their associated one of the ring members 28. The pins 29 protrude from an end surface 13*e* of the shaft support housing 13 on the orbiting scroll 26 side.

The scroll compressor 10 includes an elastic plate 30. The elastic plate 30 has an annular shape. An outer peripheral portion of the elastic plate 30 is held between an open end surface of the fixed scroll peripheral wall 25*c* and the end surface 13*e* of the shaft support housing 13. The elastic plate 30 constantly urges the orbiting scroll 26 toward the fixed scroll 25.

The scroll compressor 10 includes an eccentric shaft 31. The eccentric shaft 31 extends from the end surface 15*e* of the rotary shaft 15 at a position eccentric to an axial line L1 of the rotary shaft 15 toward the orbiting scroll 26. The eccentric shaft 31 is formed integrally with the rotary shaft 15. An axial direction of the eccentric shaft 31 coincides with the axial direction of the rotary shaft 15. The eccentric shaft 31 is inserted into the boss 26*c*.

The scroll compressor 10 includes a balance weight 32 and a bushing 33. The bushing 33 is fitted to an outer peripheral surface of the eccentric shaft 31. The balance weight 32 is integrated with the bushing 33. The balance weight 32 is formed integrally with the bushing 33. The balance weight 32 is accommodated in the peripheral wall 18 of the shaft support housing 13. The orbiting scroll 26 is supported by the eccentric shaft 31 via the bushing 33 and a rolling bearing 34, and is rotatable relative to the eccentric shaft 31.

The rotation of the rotary shaft 15 is transmitted to the orbiting scroll 26 through the eccentric shaft 31, the bushing 33, and the rolling bearing 34. This causes the orbiting scroll 26 to rotate. The pins 29 in contact with inner peripheral surfaces of their associated ring members 28 prevent the orbiting scroll 26 from rotating, and only allow the orbiting scroll 26 to make orbital motion. Thus, the orbiting scroll 26 makes orbital motion while the orbiting scroll spiral wall 26*b* is in contact with the fixed scroll spiral wall 25*b*. The volume of the compression chamber 27 reduces with orbital motion of the orbiting scroll 26, thereby compressing refrigerant in the compression chamber 27. The orbiting scroll 26 makes orbital motion inside the fixed scroll peripheral wall 25*c* with rotation of the rotary shaft 15. The balance weight 32 counterbalances a centrifugal force that acts on the orbiting scroll 26 when the orbiting scroll 26 makes orbital motion. This reduces the amount of imbalance of the orbiting scroll 26.

As illustrated in FIGS. 1 and 2, the discharge housing 14 includes an end wall 14*a* having a plate shape, and a peripheral wall 14*b* having a tubular shape. The peripheral wall 14*b* extends in a tubular shape from an outer peripheral portion of the end wall 14*a*. An axial direction of the peripheral wall 14*b* coincides with the axial direction of the rotary shaft 15. The peripheral wall 14*b* surrounds the fixed scroll peripheral wall 25*c*. Thus, the peripheral wall 14*b* surrounds the fixed scroll 25. Accordingly, the fixed scroll 25 is accommodated in the housing 11.

As illustrated in FIG. 2, the peripheral wall 14*b* has a plurality of bulging portions 14*d*. The peripheral wall 14*b* has six bulging portions 14*d*. The six bulging portions 14*d* are arranged at regular intervals in a circumferential direction of the peripheral wall 14*b*. In this way, the six bulging portions 14*d* are spaced from each other in the circumferential direction of the peripheral wall 14*b*. The bulging portions 14*d* each protrude toward the fixed scroll peripheral wall 25*c* with an inner peripheral surface of the peripheral wall 14*b* formed into a convex shape. An outer surface of each of the bulging portions 14*d* is a curved surface curved in an arc shape which is convex toward the fixed scroll peripheral wall 25*c*.

As illustrated in FIGS. 1 and 2, the discharge housing 14 has a plurality of bolt insertion holes 14*c*. Six bolt insertion holes 14*c* are formed in the discharge housing 14. The bolt insertion holes 14*c* extend through portions of the peripheral wall 14*b* corresponding to the bulging portions 14*d* in an axial direction of the peripheral wall 14*b*. For the sake of description, only one of the bolt insertion holes 14*c* is illustrated in FIG. 1. The bolt insertion holes 14*c* are in communication with the associated bolt insertion holes 19*a* of the flange wall 19.

As illustrated in FIG. 1, bolts B1, as fastening members extending through the bolt insertion holes 14*c*, are inserted through the bolt insertion holes 19*a* of the flange wall 19, and screwed into the internally threaded holes 12*c* of the suction housing 12, respectively. As a result, the shaft support housing 13 is connected to the peripheral wall 12*b* of the suction housing 12, and the discharge housing 14 is connected to the peripheral wall 12*b* of the suction housing 12 via the flange wall 19 of the shaft support housing 13. In this way, the discharge housing 14 is fastened to the suction housing 12 by the bolts B1 that extend through the portions of the peripheral wall 14*b* corresponding to the bulging portions 14*d* in the axial direction of the peripheral wall 14*b*. The suction housing 12, the shaft support housing 13, and the discharge housing 14 are arranged in this order in the axial direction of the rotary shaft 15. The flange wall 19 of the shaft support housing 13 is held between the peripheral wall 14*b* of the discharge housing 14 and the peripheral wall 12*b* of the suction housing 12.

The fixed scroll peripheral wall 25*c* of the fixed scroll 25 is held between the end wall 14*a* of the discharge housing 14 and the shaft support housing 13 in the axial direction of the peripheral wall 14*b* by an axial force, which is a fastening force of the bolts B1. In this way, the fixed scroll 25 is fixed to the housing 11 with the fixed scroll peripheral wall 25*c* held between the end wall 14*a* of the discharge housing 14 and the shaft support housing 13 in the axial direction of the peripheral wall 14*b* by the fastening force of the bolts B1.

The scroll compressor 10 has a discharge chamber 40. The discharge chamber 40 is defined between the end wall 14*a* of the discharge housing 14 and the fixed scroll base plate 25*a*. Thus, the discharge housing 14 defines the discharge chamber 40 between the end wall 14*a* and the fixed scroll base plate 25*a*. Refrigerant compressed in the compression chamber 27 is discharged to the discharge chamber 40 through the discharge port 25*h*. A gasket 41 seals a portion between the end wall 14*a* of the discharge housing 14 and the fixed scroll base plate 25*a* and around the discharge chamber 40.

The discharge housing 14 has an outlet port 14*h*. The outlet port 14*h* is formed in the end wall 14*a* of the discharge housing 14. The outlet port 14*h* is in communication with the discharge chamber 40. The outlet port 14*h* allows refrigerant in the discharge chamber 40 to be discharged to an outside.

Backpressure Chamber

A backpressure chamber 45 is defined between the orbiting scroll base plate 26*a* of the orbiting scroll 26 and the shaft support housing 13. The backpressure chamber 45 is formed on a side of the orbiting scroll base plate 26*a* opposite from the fixed scroll base plate 25*a* in the housing 11. The shaft support housing 13 separates the backpressure chamber 45 from the suction chamber 20. An inside of the peripheral wall 18 of the shaft support housing 13 is a portion of the backpressure chamber 45. In addition, a gap between the elastic plate 30 and the shaft support housing 13 is a portion of the backpressure chamber 45.

The scroll compressor 10 includes a supply passage 46. The supply passage 46 is formed in the orbiting scroll 26. A first end of the supply passage 46 is opened at a distal end of the orbiting scroll spiral wall 26*b*. The first end of the supply passage 46 is communicable with the compression chamber 27. A second end of the supply passage 46 is in communication with the backpressure chamber 45. The supply passage 46 extends through an inner end of the orbiting scroll spiral wall 26*b*, which converges in a spiral shape toward the center of the orbiting scroll 26, and the orbiting scroll base plate 26*a*.

The supply passage 46 allows part of refrigerant compressed in the compression chamber 27 to be supplied to the backpressure chamber 45. As a result, the pressure in the backpressure chamber 45 is higher than that in the suction chamber 20. An increase of the pressure in the backpressure chamber 45 urges the orbiting scroll 26 toward the fixed scroll 25 so that the distal end of the orbiting scroll spiral wall 26*b* is pressed against the fixed scroll base plate 25*a*. In this way, refrigerant for urging the orbiting scroll 26 toward the fixed scroll 25 is introduced into the backpressure chamber 45.

Intake Passage

The scroll compressor 10 has an intake passage 35. The intake passage 35 has a plurality of first grooves 36, a plurality of first holes 37, and a plurality of second grooves 38. The first grooves 36 are formed in the inner peripheral surface of the peripheral wall 12*b* of the suction housing 12. Six first grooves 36 are formed in the inner peripheral surface of the peripheral wall 12*b* of the suction housing 12. The first grooves 36 are opened at the opening end of the peripheral wall 12*b*. The first holes 37 are formed in an outer peripheral portion of the flange wall 19 of the shaft support housing 13. Six first holes 37 are formed in the outer peripheral portion of the flange wall 19. The first holes 37 each extend through the flange wall 19 in the thickness direction thereof. The first holes 37 are in communication with their associated first grooves 36.

As illustrated in FIGS. 1 and 2, the second grooves 38 are formed in the inner peripheral surface of the peripheral wall 14*b* of the discharge housing 14. Six second grooves 38 are formed in the inner circumferential surface of the peripheral wall 14*b*. As illustrated in FIG. 2, the second grooves 38 are formed in the inner peripheral surface of the peripheral wall 14*b* so that one second groove 38 is disposed between adjacent two of the bulging portions 14*d* in the circumferential direction of the peripheral wall 14*b*. The second grooves 38 are in communication with each other via a gap between the bulging portions 14*d* and an outer peripheral surface of the fixed scroll peripheral wall 25*c*. As illustrated in FIG. 1, the second grooves 38 are in communication with their associated first holes 37. The second grooves 38 each form a portion of the intake passage 35. Therefore, the intake passage 35 is defined between the fixed scroll peripheral wall 25*c* and the peripheral wall 14*b* of the discharge housing 14.

Thick-Walled Portion and Thin-Walled Portion

Figure 3:
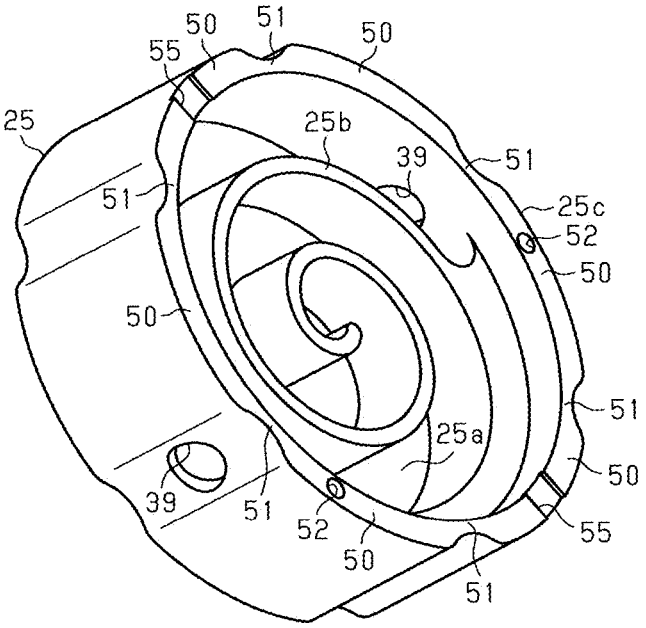
FIG. 3 is a perspective view of the fixed scroll.

As illustrated in FIGS. 2 and 3, the fixed scroll peripheral wall 25*c* has a plurality of thick-walled portions 50 and a plurality of thin-walled portions 51. The fixed scroll peripheral wall 25*c* has six thick-walled portions 50. The six thick-walled portions 50 are disposed at regular intervals in a circumferential direction of the fixed scroll peripheral wall 25*c*. In this way, the six thick-walled portions 50 are spaced from each other in the circumferential direction of the fixed scroll peripheral wall 25*c*. As illustrated in FIG. 2, the thick-walled portions 50 each are positioned inside the second grooves 38. Therefore, the intake passage 35 is disposed outside the thick-walled portions 50.

The fixed scroll peripheral wall 25*c* has six thin-walled portions 51. An outer peripheral surface of the fixed scroll peripheral wall 25*c* is recessed in a concave shape between adjacent two of the thick-walled portions 50 in the circumferential direction of the fixed scroll peripheral wall 25*c*, which forms each of the thin-walled portions 51. Outer surfaces of the thin-walled portions 51 each are a curved surface that is curved in an arc shape and recessed relative to the peripheral wall 14*b* of the discharge housing 14. The outer surfaces of the thin-walled portions 51 extend along their associated outer surfaces of the bulging portions 14*d*. Each of the thin-walled portions 51 is formed with the outer peripheral surface of the fixed scroll peripheral wall 25*c* recessed in a concave shape between adjacent two of the thick-walled portions 50 in the circumferential direction of the fixed scroll peripheral wall 25*c* to allow each of the bulging portions 14*d* to be disposed, and has a thickness smaller than a thickness of each of the thick-walled portions 50.

Here, when the fixed scroll 25 is viewed in the axial direction of the fixed scroll peripheral wall 25*c*, a straight line passing through an axial line L2 of the fixed scroll peripheral wall 25*c* and passing through two of the plurality of thin-walled portions 51 is defined as an imaginary straight line L10. When the fixed scroll peripheral wall 25*c* is viewed in the axial direction of the fixed scroll peripheral wall 25*c*, three thick-walled portions 50 are disposed on one side of the imaginary straight line L10. When the fixed scroll peripheral wall 25*c* is viewed in the axial direction of the fixed scroll peripheral wall 25*c*, three thick-walled portions 50 are disposed on the other side of the imaginary straight line L10. In this way, when the fixed scroll peripheral wall 25*c* is viewed in the axial direction of the fixed scroll peripheral wall 25*c*, the thick-walled portions 50 are disposed so that some of the plurality of thick-walled portions 50 are disposed on the one side and the other of the plurality of thick-walled portions 50 are disposed on the other side of the imaginary straight line L10.

Two intake ports 39 are formed in the fixed scroll peripheral wall 25*c*. When the fixed scroll peripheral wall 25*c* is viewed in the axial direction of the fixed scroll peripheral wall 25*c*, the intake ports 39 are formed in the fixed scroll peripheral wall 25*c* so that the intake ports 39 extend through the two thin-walled portions 51 through which the imaginary straight line L10 passes, in thickness directions of the two thin-walled portions 51, respectively. The intake ports 39 are in communication with the second grooves 38 via a gap between the bulging portions 14*d* and the outer peripheral surface of the fixed scroll peripheral wall 25*c*. Thus, the intake ports 39 are in communication with the intake passage 35. The intake ports 39 are in communication with an outermost peripheral portion of the compression chamber 27. Thus, the intake passage 35 is in communication with the compression chamber 27 via the intake port 39.

Refrigerant in the suction chamber 20 flows through the first grooves 36, the first holes 37, the second grooves 38, and the intake port 39, and is drawn into the compression chamber 27. Thus, refrigerant in the suction chamber 20 is drawn into the compression chamber 27 through the intake passage 35. The intake passage 35 is a suction pressure region through which the refrigerant drawn into the compression chamber 27 flows. Refrigerant drawn into the compression chamber 27 is compressed in the compression chamber 27 with orbital motion of the orbiting scroll 26. In this way, the compression mechanism C1 compresses refrigerant introduced to the housing 11.

Pin Insertion Hole

Pin insertion holes 52 are formed in end surfaces of the thick-walled portions 50 facing the elastic plate 30. Two thick-walled portions 50 of the six thick-walled portions 50 each have, in the end surface thereof facing the elastic plate 30, one pin insertion hole 52. Thus, the pin insertion hole 52 is formed in the end surface of any one of the plurality of thick-walled portions 50 facing the elastic plate 30. When the fixed scroll peripheral wall 25*c* is viewed in the axial direction of the fixed scroll peripheral wall 25*c*, the two pin insertion holes 52 are formed in end surfaces, facing the elastic plate 30, of two of the three thick-walled portions 50 disposed on one side of the imaginary straight line L10. When the fixed scroll peripheral wall 25*c* is viewed in the axial direction of the fixed scroll peripheral wall 25*c*, the thick-walled portions 50 each having the pin insertion hole 52 are respectively next to the two thin-walled portions 51 through which the imaginary straight line L10 passes.

Figure 4:
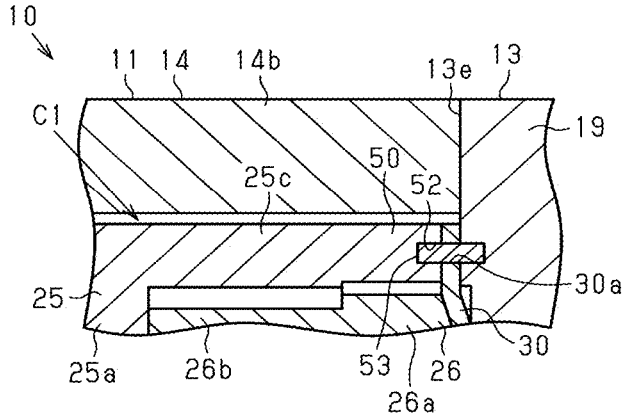
FIG. 4 is a partially enlarged cross-sectional view of the scroll compressor.

As illustrated in FIG. 4, the shaft support housing 13 has two positioning pins 53 protruding from the end surface 13*e* of the shaft support housing 13. For convenience of illustration, only one of the positioning pins 53 is illustrated in FIG. 4. The elastic plate 30 has holes 30*a* into which the positioning pins 53 are inserted. The positioning pins 53 are inserted into the pin insertion holes 52 through the holes 30*a* of the elastic plate 30. In this way, the positioning pins 53 are inserted into the pin insertion holes 52. The positioning pins 53 are inserted into the pin insertion holes 52 through the holes 30*a* of the elastic plate 30, thereby positioning the elastic plate 30.

Groove

As illustrated in FIGS. 2 and 3, grooves 55 are formed in the end surfaces of the thick-walled portions 50 facing the elastic plate 30. The grooves 55 are formed in the end surfaces, facing the elastic plate 30, of some thick-walled portions 50 in which the pin insertion holes 52 are not formed, of the plurality of thick-walled portions 50. The grooves 55 are formed in the end surfaces, facing the elastic plate 30, of two thick-walled portions 50 of the plurality of thick-walled portions 50. Thus, the fixed scroll peripheral wall 25*c* has two grooves 55.

When the fixed scroll peripheral wall 25*c* is viewed in the axial direction of the fixed scroll peripheral wall 25*c*, one of the two grooves 55 is formed in the end surface, facing the elastic plate 30, of one of the plurality of thick-walled portions 50 disposed on one side of the imaginary straight line L10. In addition, when the fixed scroll peripheral wall 25*c* is viewed in the axial direction of the fixed scroll peripheral wall 25*c*, the other of the two grooves 55 is formed in the end surface, facing the elastic plate 30, of one of the plurality of thick-walled portions 50 disposed on the other side of the imaginary straight line L10. When the fixed scroll peripheral wall 25*c* is viewed in the axial direction of the fixed scroll peripheral wall 25*c*, the two grooves 55 are respectively formed in the end surfaces, facing the elastic plate 30, of the two of the thick-walled portions 50 that face each other in a direction perpendicular to the imaginary straight line L10. In this way, the grooves 55 are formed in the end surface, facing the elastic plate 30, of one of the plurality of thick-walled portions 50 disposed on the one side of the imaginary straight line L10, and the end surface, facing the elastic plate 30, of one of the plurality of thick-walled portions 50 disposed on the other side of the imaginary straight line L10.

Figure 5:
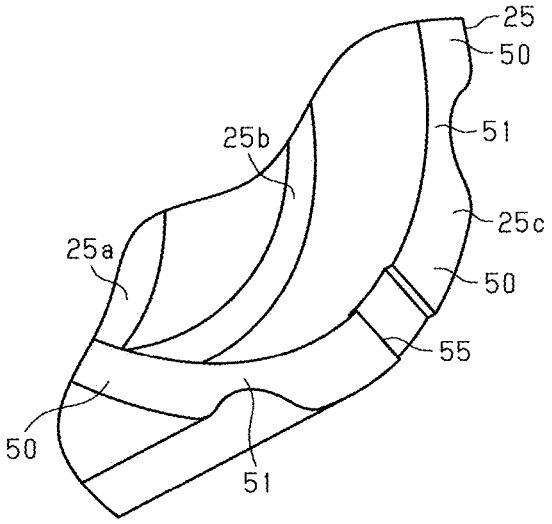
FIG. 5 is an enlarged perspective view of a groove.
Figure 6:
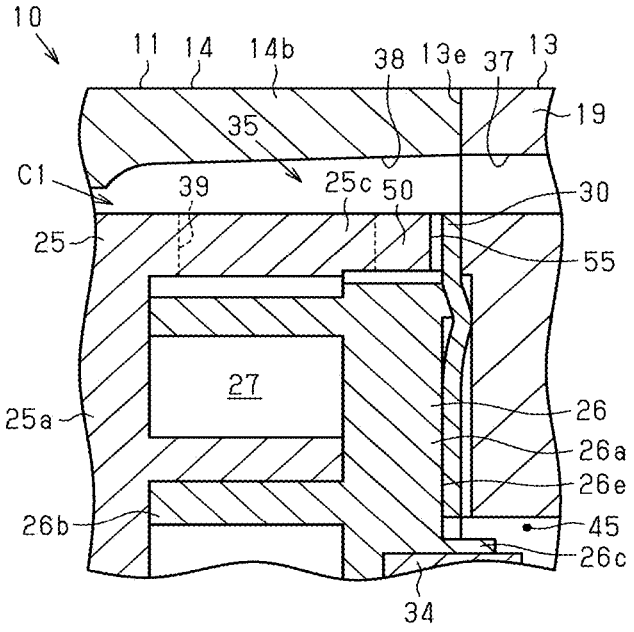
FIG. 6 is a partially enlarged cross-sectional view of the scroll compressor.

As illustrated in FIGS. 5 and 6, the grooves 55 are opened at the inner peripheral surface of the fixed scroll peripheral wall 25*c*. The grooves 55 are opened at the outer peripheral surface of the fixed scroll peripheral wall 25*c*. Insides of the grooves 55 are in communication with the intake passage 35. Therefore, the insides of the grooves 55 are the suction pressure region. As illustrated in FIG. 2, a width W1 of each of the grooves 55 in the circumferential direction of the fixed scroll peripheral wall 25*c* is smaller than a width W2 of each of the thick-walled portions 50 in the circumferential direction of the fixed scroll peripheral wall 25*c*.

Figure 7:
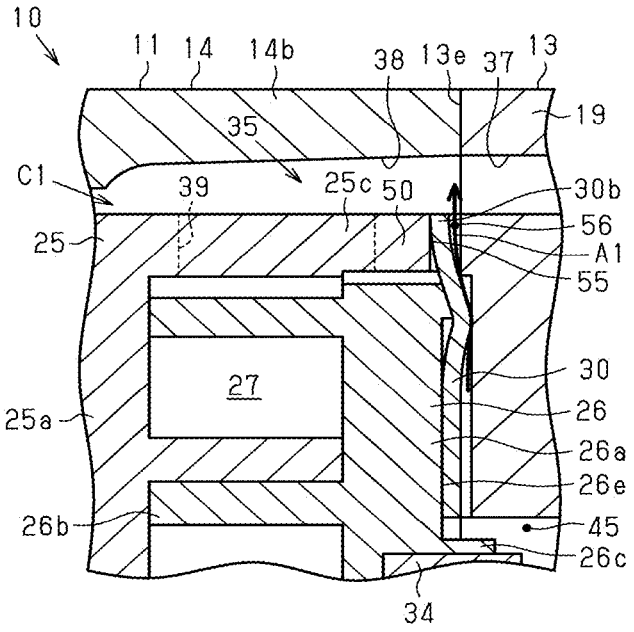
FIG. 7 is a cross-sectional view illustrating a state in which an elastic plate is elastically deformed.
Figure 8:
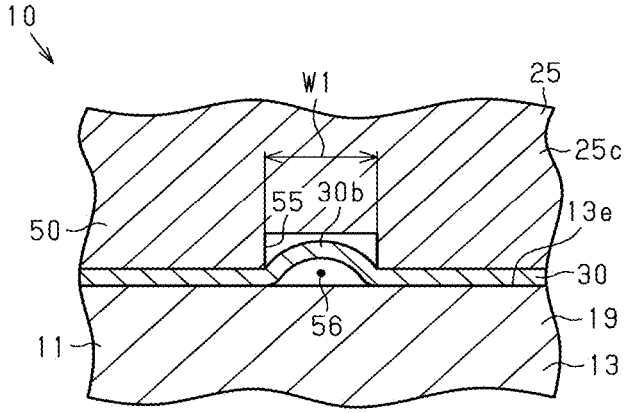
FIG. 8 is a cross-sectional view illustrating a state in which the elastic plate is elastically deformed.

As illustrated in FIGS. 7 and 8, portions of the elastic plate 30 that overlap with the grooves 55 are elastically deformed toward the grooves 55 when a pressure difference between a pressure in the backpressure chamber 45 and a pressure in the intake passage 35 exceeds a predetermined value. At this time, the grooves 55 accommodates elastic deformation of the elastic plate 30 so that the backpressure chamber 45 and the intake passage 35 are in communication with each other when the pressure difference between the pressure in the backpressure chamber 45 and the pressure in the intake passage 35 exceeds the predetermined value.

The portions of the elastic plate 30 that overlap with the grooves 55 correspond to elastically deformable portions 30*b*. When the elastically deformable portions 30*b* are elastically deformed toward the grooves 55, communication passages 56 that provides communication between the backpressure chamber 45 and the intake passage 35 are formed between the elastically deformable portions 30*b* and the shaft support housing 13. It can also be said that the elastically deformable portions 30*b* are elastically deformed by the pressure difference between the pressure in the backpressure chamber 45 and the pressure in the intake passage 35 to open and close the communication passages 56. When the elastically deformable portions 30*b* are elastically deformed by the pressure difference, the elastically deformable portions 30*b* are curved and protrude into the grooves 55.

The width W1 of each of the grooves 55 in the circumferential direction of the fixed scroll peripheral wall 25*c* is set in advance to be a width that allows elastic deformation of portions of the elastic plate 30 that overlap with the grooves 55 toward the grooves 55 when the pressure difference between the pressure in the backpressure chamber 45 and the pressure in the intake passage 35 exceeds the predetermined value. The width W1 of each of the grooves 55 in the circumferential direction of the fixed scroll peripheral wall 25*c* is determined in advance by an experiment or the like.

Operation of Embodiment

The following will describe the operation of the present embodiment.

A portion of refrigerant compressed in the compression chamber 27 is supplied to the backpressure chamber 45 via the supply passage 46. This increases the pressure in the backpressure chamber 45. Furthermore, since the orbiting scroll 26 is urged toward the fixed scroll 25, leakage of refrigerant from the compression chamber 27 is less likely to occur. As a result, the compression efficiency of the scroll compressor 10 is improved.

In the scroll compressor 10 having the above configuration, refrigerant may be cooled and liquefied when the scroll compressor 10 is stopped. If the scroll compressor 10 is started, for example, in a state in which liquefied refrigerant generated by liquefaction of refrigerant is present in the backpressure chamber 45, heat of refrigerant compressed in the compression chamber 27 may be transmitted to the liquefied refrigerant in the backpressure chamber 45 via the orbiting scroll base plate 26*a*. Then, the liquefied refrigerant in the backpressure chamber 45 vaporizes, and the pressure in the backpressure chamber 45 increases.

Here, when the pressure difference between the pressure in the backpressure chamber 45 and the pressure in the intake passage 35 exceeds the predetermined value, the grooves 55 accommodate elastic deformation of the elastic plate 30 so that the backpressure chamber 45 and the intake passage 35 are in communication with each other. Thus, as illustrated in FIG. 7, the communication passages 56 are formed between the elastically deformable portions 30*b* and the shaft support housing 13, and the refrigerant in the backpressure chamber 45 is discharged into the intake passage 35 through the communication passages 56, as indicated by an arrow A1 in FIG. 7. In this way, the refrigerant in the backpressure chamber 45 is discharged to the intake passage 35 through the grooves 55, which suppresses an excessive increase of the pressure in the backpressure chamber 45. As a result, a problem that orbital motion of the orbiting scroll 26 is less likely to occur because of the excessive increase of the pressure in the backpressure chamber 45 to reduce the compression efficiency of the scroll compressor 10 is avoided.

The thin-walled portions 51 are closer to the bulging portions 14*d* than the thick-walled portions 50. The bolts B1 extend through portions, corresponding to the bulging portions 14*d*, of the peripheral wall 14*b* of the discharge housing 14 in the axial direction of the peripheral wall 14*b*. Therefore, a reaction force from the shaft support housing 13 caused by a fastening force of the bolts B1 is more likely to locally act on the end surfaces of the thin-walled portions 51 facing the elastic plate 30, as compared to the end surfaces of the thick-walled portions 50 facing the elastic plate 30.

Here, the grooves 55 are formed in the end surfaces of the thick-walled portions 50 facing the elastic plate 30. Therefore, the end surfaces of the thin-walled portions 51 facing the elastic plate 30 can suitably receive the reaction force from the shaft support housing 13 caused by the fastening force of the bolts B1.

Effects of Embodiment

The above-described embodiment offers the following effects.

(1) The grooves 55 accommodate elastic deformation of the elastic plate 30 so that the backpressure chamber 45 and the intake passage 35 are in communication with each other when the pressure difference between the pressure in the backpressure chamber 45 and the pressure in the intake passage 35 exceeds the predetermined value. As a result, refrigerant in the backpressure chamber 45 is discharged to the intake passage 35 through the grooves 55, so that an excessive increase of the pressure in the backpressure chamber 45 may be suppressed. The grooves 55 are formed in the end surfaces of the thick-walled portions 50 facing the elastic plate 30. Therefore, the end surfaces of the thin-walled portions 51 facing the elastic plate 30 can suitably receive the reaction force from the shaft support housing 13 caused by the fastening force of the bolts B1. As a result, the pressure in the backpressure chamber 45 is prevented from increasing excessively while the strength of the fixed scroll 25 is maintained.

(2) The end surfaces of the thick-walled portions 50 facing the elastic plate 30 are suitable portions for forming the pin insertion holes 52 in an end surface of the fixed scroll peripheral wall 25*c* facing the elastic plate 30, as compared to the end surfaces of the thin-walled portions 51 facing the elastic plate 30. The grooves 55 are formed in the end surfaces of the thick-walled portions 50, facing the elastic plate 30, in which the pin insertion holes 52 are not formed, of the plurality of thick-walled portions 50. Thus, the grooves 55 may be more easily formed in the end faces of the thick-walled portions 50 facing the elastic plate 30, as compared with a case in which the grooves 55 are formed in the end surfaces of the thick-walled portions 50, facing the elastic plate 30, in which the pin insertion holes 52 are formed.

(3) The grooves 55 are formed in the end surfaces, facing the elastic plate 30, of two thick-walled portions 50 of the plurality of thick-walled portions 50. This allows refrigerant in the backpressure chamber 45 to be more efficiently discharged into the intake passage 35 through the grooves 55, as compared with a case in which the groove 55 is formed only in the end surface, facing the elastic plate 30, of one thick-walled portion 50 of the plurality of thick-walled portions 50.

(4) The grooves 55 are formed in the end surface, facing the elastic plate 30, of one of the plurality of thick-walled portions 50 disposed on the one side of the imaginary straight line L10, and the end surface, facing the elastic plate 30, of one of the plurality of thick-walled portions 50 disposed on the other side of the imaginary straight line L10. As a result, depending on an orbital position of the orbiting scroll 26, the refrigerant in the backpressure chamber 45 may be efficiently discharged to the intake passage 35 through one of the grooves 55 formed in the end surface, facing the elastic plate 30, of one of the plurality of thick-walled portions 50 disposed on the one side of the imaginary straight line L10. In addition, depending on the orbital position of the orbiting scroll 26, the refrigerant in the backpressure chamber 45 may be efficiently discharged to the intake passage 35 through the other of the grooves 55 formed in the end surface, facing the elastic plate 30, of one of the plurality of thick-walled portions 50 disposed on the other side of the imaginary straight line L10.

(5) A configuration in which the width W1 of each of the grooves 55 in the circumferential direction of the fixed scroll peripheral wall 25*c* is smaller than the width W2 of each of the thick-walled portions 50 in the circumferential direction of the fixed scroll peripheral wall 25*c* is a suitable for forming the grooves 55 in the end surfaces of the thick-walled portions 50 facing the elastic plate 30.

Modification

The above-described embodiment may be modified in various manners, as exemplified below. The above-described embodiment and the following modifications may be combined within the scope consistent with the present disclosure.

In the embodiment, the grooves 55 may be formed in the end surfaces, facing the elastic plate 30, of three or more thick-walled portions 50 of the plurality of thick-walled portions 50. Thus, three or more grooves 55 may be formed in the fixed scroll peripheral wall 25*c*. In short, the grooves 55 only need to be formed in the end surfaces, facing the elastic plate 30, of at least two thick-walled portions 50 of the plurality of thick-walled portions 50.

In the embodiment, the grooves 55 may be formed in the end surfaces, facing the elastic plate 30, of two or more thick-walled portions 50 of the plurality of thick-walled portions 50 disposed on the one side of the imaginary straight line L10. In the embodiment, the grooves 55 may be formed in the end surfaces, facing the elastic plate 30, of two or more thick-walled portions 50 of the plurality of thick-walled portions 50 disposed on the other side of the imaginary straight line L10. In short, the grooves 55 need to be formed in the end surface, facing the elastic plate 30, of at least one of the plurality of thick-walled portions 50 disposed on the one side of the imaginary straight line L10, and the end surface, facing the elastic plate 30, of at least one of the plurality of thick-walled portions 50 disposed on the other side of the imaginary straight line L10.

In the embodiment, the groove 55 may be formed only in the end surface, facing the elastic plate 30, of one thick-walled portion 50 of the plurality of thick-walled portions 50. Thus, only one groove 55 may be formed in the fixed scroll peripheral wall 25*c*.

In the embodiment, the grooves 55 may be formed in the end surfaces, facing the elastic plate 30, of the thick-walled portions 50 in which the pin insertion holes 52 are formed, of the plurality of thick-walled portions 50.

In the embodiment, the number of each of the thick-walled portions 50 and the thin-walled portions 51 is not particularly limited as long as they are two or more.

In the embodiment, for example, press-fit pins may be used as the fastening members, instead of the bolts B1.

In the embodiment, the bolt insertion holes 19*a* do not have to be formed in the outer peripheral portion of the flange wall 19 of the shaft support housing 13. Furthermore, the flange wall 19 does not have to be held between the peripheral wall 14*b* of the discharge housing 14 and the peripheral wall 12*b* of the suction housing 12, but, for example, may be press-fitted to the inner peripheral surface of the peripheral wall 12*b* of the suction housing 12. Therefore, the shaft support housing 13 does not have to be fastened to the suction housing 12 by the bolts B1 as the fastening members.

In the embodiment, the number of the intake ports 39 is not particularly limited.

In the embodiment, the scroll compressor 10 does not have to be driven by the motor 22, and may be driven by, for example, an engine of a vehicle.

Although the scroll compressor 10 is used for the vehicle air conditioner in the above embodiment, the use of the scroll compressor 10 is not limited thereto. The scroll compressor 10 may be used in any desirable manner as long as the scroll compressor 10 is used for compressing refrigerant.

[Additional Notes]

The following will describe technical ideas that can be grasped from the embodiment and its modifications.

<Additional Note 1>

A scroll compressor comprising:

a housing;

a rotary shaft rotatably supported by the housing;

a fixed scroll fixed to the housing, and including a fixed scroll base plate, a fixed scroll spiral wall that extends from the fixed scroll base plate, and a fixed scroll peripheral wall that extends from the fixed scroll base plate and surrounds the fixed scroll spiral wall;

an orbiting scroll including an orbiting scroll base plate that faces the fixed scroll base plate, and an orbiting scroll spiral wall that extends from the orbiting scroll base plate toward the fixed scroll base plate and meshes with the fixed scroll spiral wall, the orbiting scroll being configured to make orbital motion inside the fixed scroll peripheral wall with rotation of the rotary shaft;

an elastic plate having an annular shape, and configured to urge the orbiting scroll toward the fixed scroll; and a compression chamber in which a refrigerant is compressed and that is defined by the fixed scroll base plate, the fixed scroll spiral wall, the orbiting scroll base plate, and the orbiting scroll spiral wall, the housing including:

a shaft support housing that is disposed on a side of the orbiting scroll base plate opposite from the fixed scroll base plate, and supports the rotary shaft;

a discharge housing that includes an end wall, and a peripheral wall extending from the end wall in a tubular shape so as to surround the fixed scroll peripheral wall, and defines a discharge chamber to which the refrigerant compressed in the compression chamber is discharged between the end wall and the fixed scroll base plate; and a suction housing cooperating with the shaft support housing to define a suction chamber into which the refrigerant is drawn from an outside, an intake passage being defined between the fixed scroll peripheral wall and the peripheral wall, the intake passage through which the refrigerant in the suction chamber is drawn into the compression chamber, a backpressure chamber being defined between the orbiting scroll base plate and the shaft support housing, the backpressure chamber into which the refrigerant to urge the orbiting scroll toward the fixed scroll is introduced, an outer peripheral portion of the elastic plate being held between the fixed scroll peripheral wall and the shaft support housing, a plurality of bulging portions being spaced from each other in a circumferential direction of the peripheral wall, and protruding toward the fixed scroll peripheral wall with an inner peripheral surface of the peripheral wall formed into a convex shape, a fastening member extending through a portion of the peripheral wall, corresponding to each of the plurality of bulging portions, in an axial direction of the peripheral wall to fasten the discharge housing to the suction housing, the fixed scroll being fixed to the housing with the fixed scroll peripheral wall held between the end wall and the shaft support housing by a fastening force of the fastening member, and the fixed scroll peripheral wall including:

a plurality of thick-walled portions spaced from each other in the circumferential direction of the fixed scroll peripheral wall; and a plurality of thin-walled portions formed with an outer peripheral surface of the fixed scroll peripheral wall recessed in a concave shape between the plurality of thick-walled portions disposed adjacent to each other in the circumferential direction of the fixed scroll peripheral wall to allow the bulging portions to be disposed, and each having a thickness smaller than a thickness of each of the plurality of thick-walled portions, wherein a groove is formed in at least one of end surfaces of the plurality of thick-walled portions facing the elastic plate, the groove accommodating elastic deformation of the elastic plate so that the backpressure chamber and the intake passage are in communication with each other when a pressure difference between a pressure in the backpressure chamber and a pressure in the intake passage exceeds a predetermined value.

<Additional Note 2>

The scroll compressor according to <Additional Note 1>, wherein a pin insertion hole into which a positioning pin for positioning the elastic plate is inserted is formed in at least one of the end surfaces of the plurality of thick-walled portions facing the elastic plate, and the groove is formed in at least one of the end surfaces of the plurality of thick-walled portions facing the elastic plate, in which the pin insertion hole is not formed.

<Additional Note 3>

The scroll compressor according to <Additional Note 1> or <Additional Note 2>, wherein the groove includes a plurality of the grooves formed in the end surfaces of at least two of the plurality of thick-walled portions facing the elastic plate.

<Additional Note 4>

The scroll compressor according to <Additional Note 3>, wherein a straight line passing through an axial line of the fixed scroll peripheral wall and two of the plurality of thin-walled portions is defined as an imaginary straight line when the fixed scroll is viewed in an axial direction of the fixed scroll peripheral wall, the plurality of thick-walled portions includes a plurality of thick-walled portions disposed on one side of the imaginary straight line and a plurality of thick-walled portions disposed on the other side of the imaginary straight line, when the fixed scroll peripheral wall is viewed in the axial direction, the groove includes a plurality of the grooves formed in at least one of the end surfaces of the plurality of thick-walled portions disposed on the one side of the imaginary straight line, and in at least one of the end surfaces of the plurality of thick-walled portions disposed on the other side of the imaginary straight line.

<Additional Note 5>

The electric compressor according to any one of <Additional Note 1> to <Additional Note 4>, wherein a width of the groove in the circumferential direction is smaller than a width of each of the plurality of thick-walled portions in the circumferential direction.

What is claimed is:

1. A scroll compressor comprising:

a housing;

a rotary shaft rotatably supported by the housing;

a fixed scroll fixed to the housing, and including a fixed scroll base plate, a fixed scroll spiral wall that extends from the fixed scroll base plate, and a fixed scroll peripheral wall that extends from the fixed scroll base plate and surrounds the fixed scroll spiral wall;

an orbiting scroll including an orbiting scroll base plate that faces the fixed scroll base plate, and an orbiting scroll spiral wall that extends from the orbiting scroll base plate toward the fixed scroll base plate and meshes with the fixed scroll spiral wall, the orbiting scroll being configured to make orbital motion inside the fixed scroll peripheral wall with rotation of the rotary shaft;

an elastic plate having an annular shape, and configured to urge the orbiting scroll toward the fixed scroll; and a compression chamber in which a refrigerant is compressed and that is defined by the fixed scroll base plate, the fixed scroll spiral wall, the orbiting scroll base plate, and the orbiting scroll spiral wall, the housing including:

a shaft support housing that is disposed on a side of the orbiting scroll base plate opposite from the fixed scroll base plate, and supports the rotary shaft;

a discharge housing that includes an end wall, and a peripheral wall extending from the end wall in a tubular shape so as to surround the fixed scroll peripheral wall, and defines a discharge chamber to which the refrigerant compressed in the compression chamber is discharged between the end wall and the fixed scroll base plate; and a suction housing cooperating with the shaft support housing to define a suction chamber into which the refrigerant is drawn from an outside, an intake passage being defined between the fixed scroll peripheral wall and the peripheral wall of the discharge housing, the intake passage through which the refrigerant in the suction chamber is drawn into the compression chamber, a backpressure chamber being defined between the orbiting scroll base plate and the shaft support housing, the backpressure chamber into which the refrigerant to urge the orbiting scroll toward the fixed scroll is introduced, an outer peripheral portion of the elastic plate being held between the fixed scroll peripheral wall and the shaft support housing, a plurality of bulging portions being spaced from each other in a circumferential direction of the peripheral wall of the discharge housing, and protruding toward the fixed scroll peripheral wall with an inner peripheral surface of the peripheral wall of the discharge housing formed into a convex shape, a fastener extending through a portion of the peripheral wall of the discharge housing, corresponding to each of the plurality of bulging portions, in an axial direction of the peripheral wall of the discharge housing to fasten the discharge housing to the suction housing, the fixed scroll being fixed to the housing with the fixed scroll peripheral wall held between the end wall and the shaft support housing by a fastening force of the fastener, and the fixed scroll peripheral wall including:

a plurality of thick-walled portions spaced from each other in the circumferential direction of the fixed scroll peripheral wall; and a plurality of thin-walled portions formed with an outer peripheral surface of the fixed scroll peripheral wall recessed in a concave shape between the plurality of thick-walled portions disposed adjacent to each other in the circumferential direction of the fixed scroll peripheral wall to allow the bulging portions to be disposed therein, and each of the plurality of thin-walled portions having a thickness smaller than a thickness of each of the plurality of thick-walled portions, wherein a groove is formed in at least one of the end surfaces of the plurality of thick-walled portions facing the elastic plate, the groove accommodating elastic deformation of the elastic plate so that the backpressure chamber and the intake passage are in communication with each other when a pressure difference between a pressure in the backpressure chamber and a pressure in the intake passage exceeds a predetermined value.

2. The scroll compressor according to claim 1, wherein a pin insertion hole into which a positioning pin for positioning the elastic plate is inserted is formed in at least one of the end surfaces of the plurality of thick-walled portions facing the elastic plate, and the groove is formed in at least one of the end surfaces of the plurality of thick-walled portions facing the elastic plate, in which the pin insertion hole is not formed.

3. The scroll compressor according to claim 1, wherein the groove includes a plurality of the grooves formed in the end surfaces of at least two of the plurality of thick-walled portions facing the elastic plate.

4. The scroll compressor according to claim 3, wherein a straight line passing through an axial line of the fixed scroll peripheral wall and two of the plurality of thin-walled portions is defined as an imaginary straight line when the fixed scroll is viewed in an axial direction of the fixed scroll peripheral wall, the plurality of thick-walled portions includes a plurality of thick-walled portions disposed on one side of the imaginary straight line and a plurality of thick-walled portions disposed on the other side of the imaginary straight line, when the fixed scroll peripheral wall is viewed in the axial direction, the groove includes a plurality of the grooves formed in at least one of the end surfaces of the plurality of thick-walled portions disposed on the one side of the imaginary straight line, and in at least one of the end surfaces of the plurality of thick-walled portions disposed on the other side of the imaginary straight line.

5. The scroll compressor according to claim 1, wherein a width of the groove in the circumferential direction is smaller than a width of each of the plurality of thick-walled portions in the circumferential direction.

* * * * *